US007543640B2

(12) United States Patent
MacDougall

(10) Patent No.: US 7,543,640 B2
(45) Date of Patent: Jun. 9, 2009

(54) SYSTEM AND METHOD FOR CONTROLLING UNDESIRABLE FLUID INCURSION DURING HYDROCARBON PRODUCTION

(75) Inventor: Thomas D. MacDougall, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 399 days.

(21) Appl. No.: 11/162,215

(22) Filed: Sep. 1, 2005

(65) Prior Publication Data

US 2007/0044963 A1 Mar. 1, 2007

(51) Int. Cl.
*E21B 43/04* (2006.01)

(52) U.S. Cl. ..... 166/278; 166/51

(58) Field of Classification Search ..... None
See application file for complete search history.

(56) References Cited

U.S. PATENT DOCUMENTS

| | | | | |
|---|---|---|---|---|
| 2,365,033 | A | 12/1944 | Williams | |
| 2,945,451 | A | 7/1960 | Griswold | |
| 3,385,367 | A | 5/1968 | Kollsman | |
| 4,862,967 | A | 9/1989 | Harris | |
| 4,936,386 | A * | 6/1990 | Colangelo | 166/292 |
| 6,109,350 | A * | 8/2000 | Nguyen et al. | 166/281 |
| 6,634,431 | B2 | 10/2003 | Cook et al. | |
| 6,719,064 | B2 | 4/2004 | Price-Smith et al. | |
| 6,722,437 | B2 | 4/2004 | Vercaemer et al. | |
| 6,820,690 | B2 | 11/2004 | Vercaemer et al. | |
| 6,834,725 | B2 | 12/2004 | Whanger et al. | |
| 6,848,505 | B2 | 2/2005 | Richard et al. | |
| 6,854,522 | B2 | 2/2005 | Brezinski et al. | |
| 2003/0146003 | A1 | 8/2003 | Duggan et al. | |
| 2004/0118572 | A1 | 6/2004 | Whanger et al. | |
| 2004/0123983 | A1 | 7/2004 | Cook et al. | |
| 2005/0072576 | A1 | 4/2005 | Henriksen et al. | |
| 2005/0072579 | A1 | 4/2005 | Gambier | |
| 2008/0135250 | A1 * | 6/2008 | Bosma et al. | 166/285 |

FOREIGN PATENT DOCUMENTS

| | | | |
|---|---|---|---|
| EP | 0933414 | A1 | 4/2003 |

(Continued)

OTHER PUBLICATIONS

"Sand" Schlumberger Oilfield Glossary, retrieved Feb. 12, 2008 from http://wwww.glossary.oilfield.slb.com/Display.cfm?Term=sand.*

(Continued)

*Primary Examiner*—Zakiya W Bates
*Assistant Examiner*—Angela M DiTrani
(74) *Attorney, Agent, or Firm*—Jeremy P. Welch; Van Someren, PC; James L Kurka

(57) ABSTRACT

A technique is provided to control flow in subterranean applications, such as hydrocarbon fluid production applications. The technique utilizes an aggregate formed, at least in part, of particles that swell in the presence of a specific substance or substances. The aggregate is deployed as a slurry or in other forms to desired subterranean locations. Once located, the aggregate allows the flow of hydrocarbon fluids but swells upon contact with the specific substance or substances to limit inflow of undesirable fluids.

22 Claims, 5 Drawing Sheets

FOREIGN PATENT DOCUMENTS

| | | | |
|---|---|---|---|
| GB | 2393962 | A | 4/2004 |
| WO | 8903926 | A1 | 5/1989 |
| WO | WO02/20941 | A1 | 3/2002 |
| WO | WO02/059452 | A1 | 8/2002 |
| WO | WO03/008756 | A1 | 1/2003 |
| WO | WO03/056125 | A2 | 7/2003 |
| WO | WO2004/005665 | A3 | 1/2004 |
| WO | WO2004/005669 | A1 | 1/2004 |
| WO | 2004022911 | A1 | 3/2004 |

OTHER PUBLICATIONS

Al-Anazi, Hamoud A., Sharma, Mukul M.; Evaluation of a pH-Sensitive Polymer for Gravel-Packing Operations; SPE Production and Operations Symposium; Oklahoma City, OK; Mar. 24-27, 2001; SPE 67292; Society of Petroleum Engineers Inc., Richmond, TX.

Al-Anazi, Hamoud A., Sharma, Mukul M.; Use of a pH-Sensitive Polymer for Conformance Control; SPE International Symposium and Exhibition on Formation Damage Control; Lafayette, LA; Feb. 20-21, 2002; SPE 73782; Society of Petroleum Engineers Inc., Richmond, TX.

Al-Anazi, Hamoud A., Sharma, Mukul M.; Evaluation of a pH-Sensitive Polymer for Gravel-Packing Operations; Revised manuscript (of SPE 67292); SPE 76813 revised Jan. 2, 2002; Society of Petroleum Engineers Inc., Richmond, TX.

* cited by examiner

SYSTEM AND METHOD FOR CONTROLLING UNDESIRABLE FLUID INCURSION DURING HYDROCARBON PRODUCTION

BACKGROUND

Various subterranean formations contain hydrocarbons in fluid form which can be produced to a surface location for collection. However, many of these formations also contain fluids, e.g. water, including brine, and gases, which can intrude on the production of hydrocarbon fluids. Accordingly, it often is necessary to control the intrusion of water through various techniques, including mechanical separation of the water from the hydrocarbon fluids and controlling the migration of water to limit the intrusion of water into the produced hydrocarbon fluids. However, these techniques tend to be relatively expensive and complex.

In a typical production example, a wellbore is drilled into or through a hydrocarbon containing formation. The wellbore is then lined with a casing, and a completion, such as a gravel pack completion, is moved downhole. The completion contains a screen through which hydrocarbon fluids flow from the formation to the interior of the completion for production to the surface. The annulus between the screen and the surrounding casing or wellbore wall often is gravel packed to control the buildup of sand around the screen. During production, a phenomenon known as watercut sometimes occurs in which water migrates along the wellbore towards the screen into which the hydrocarbon fluids flow for production. If the watercut becomes too high, water can mix with the produced hydrocarbon fluids. Unless this migration of water is controlled, the well can undergo a substantial reduction in efficiency or even be rendered no longer viable.

SUMMARY

In general, the present invention provides a system and method for controlling the undesirable flow of water in subterranean locations. In the production of hydrocarbon fluids, the system and method provide an economical technique for providing a pack that limits or stops the intrusion of undesirable fluids by decreasing the near wellbore permeability in an affected zone. The system and method also can be utilized in other subterranean and production related environments and applications to control undesired fluid flow, e.g. undesired water and/or gas migration.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to controlling fluid flow, and particularly to controlling the flow of unwanted water or gas through a pack deployed for control of sanding in a subterranean environment. Generally, an aggregate having particles that expand or swell in the presence of water, or other specific substances, is provided to limit or prevent the flow of water or undesired gas through a specific area, e.g. a gravel pack area. In one embodiment, the expandable particles are not substantially affected by exposure to hydrocarbon fluids, so the aggregate can be located in specific regions susceptible to detrimental incursion of water migration that can interfere with the production of hydrocarbon fluids. Alternatively, the swellable material can be provided with a coating such that when the swellable material is exposed to an activation fluid, e.g. an acid or a base, the coating is removed, allowing the packing material to swell. Likewise, a particular elastomeric compound can be chosen so that it is selectively swellable in the presence of certain chemicals. This allows the swell pack to be run in a water based mud or activated at a later stage via controlled intervention.

In one sense, the present system and methodology can be described as utilizing a pumped slurry aggregate to form a downhole pack system that protects a wellbore from sand intrusion with particles that can change in size. The ability to change particle size enables the near wellbore permeability to be adjusted. This creates a "skin effect" that decreases the near wellbore permeability with respect to the reservoir rock and effectively chokes back flow from that particular zone of the well.

By way of example, many production wells have the potential for water, or undesirable gas, inflow at some point in the life of the well. Water inflow, often in the form of watercut, can intrude on the hydrocarbon fluids being produced by a completion disposed in a wellbore. The incursion of water can lead to reduce hydrocarbon fluid production and can even rendered the well no longer viable for hydrocarbon production, unless the influx of water is blocked. The expandable particles are used to create a swellable gravel pack that swells in the presence of water and blocks water migration along the wellbore.

Figure 1:
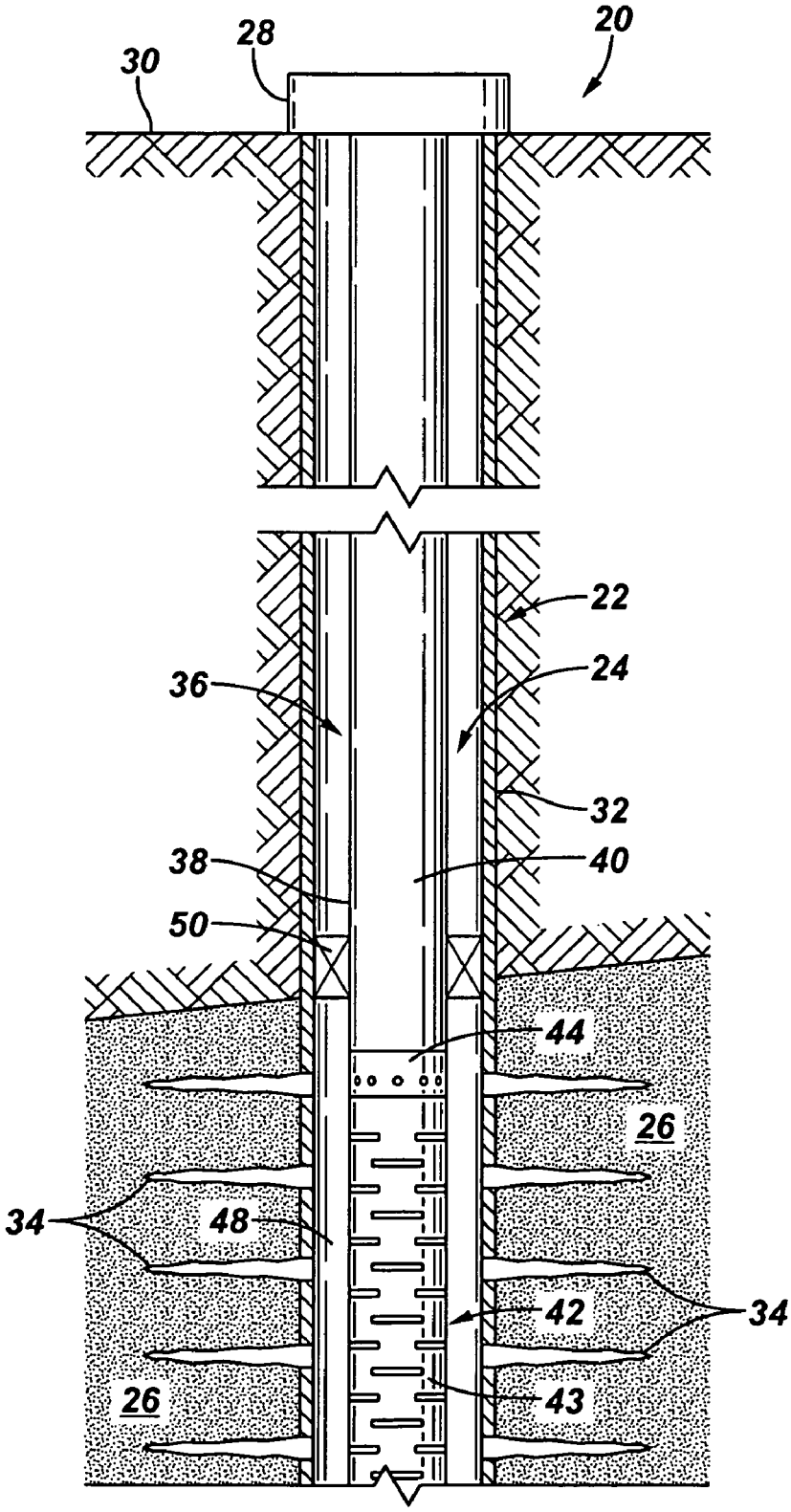
FIG. 1 is a schematic view of a well in which a completion has been positioned in a wellbore to receive a swell pack, according to an embodiment of the present invention.

Referring generally to FIG. 1, an embodiment of a gravel pack application that can utilize a "swell pack" to block potential undesirable fluid incursion is illustrated. It should be noted, however, that the illustrated embodiment is one example of many potential applications and is provided for purposes of explanation. Many other types of applications utilizing a variety of completion equipment, gravel pack techniques and wellbore orientations can benefit from the water control system described herein.

In the embodiment of FIG. 1, a well site 20 is illustrated as having a well 22 comprising a wellbore 24 drilled into a formation 26. Wellbore 24 extends downwardly from a wellhead 28 positioned at a surface 30 of the earth. Wellbore 24 is lined by a casing 32 which may have perforations 34 through which fluids flow from formation 26 into wellbore 24 for production to a desired collection location.

Additionally, wellbore 24 provides access for well equipment 36 used in the production of hydrocarbon fluids from formation 26. In this embodiment, well equipment 36 may comprise a well completion 38 having, for example, tubing 40, e.g. production tubing, coupled to a screen 42 through which formation fluids flow radially inward for production. Screen 42 may be constructed in a variety of configurations, but is illustrated as a slotted liner 43. Well completion 38 also may comprise a crossover 44 through which a gravel pack slurry 46 (see FIG. 2) is introduced to a gravel pack region 48 surrounding screen 42.

Figure 2:
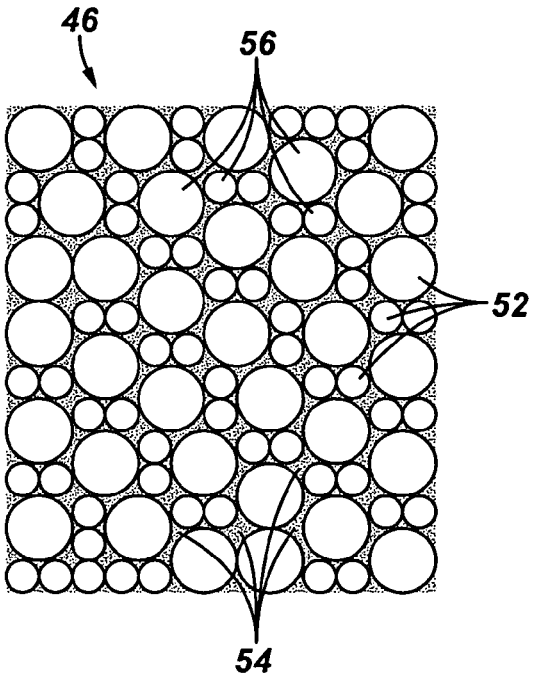
FIG. 2 illustrates a slurry mixture containing expandable particles, according to an embodiment of the present invention.
Figure 3:
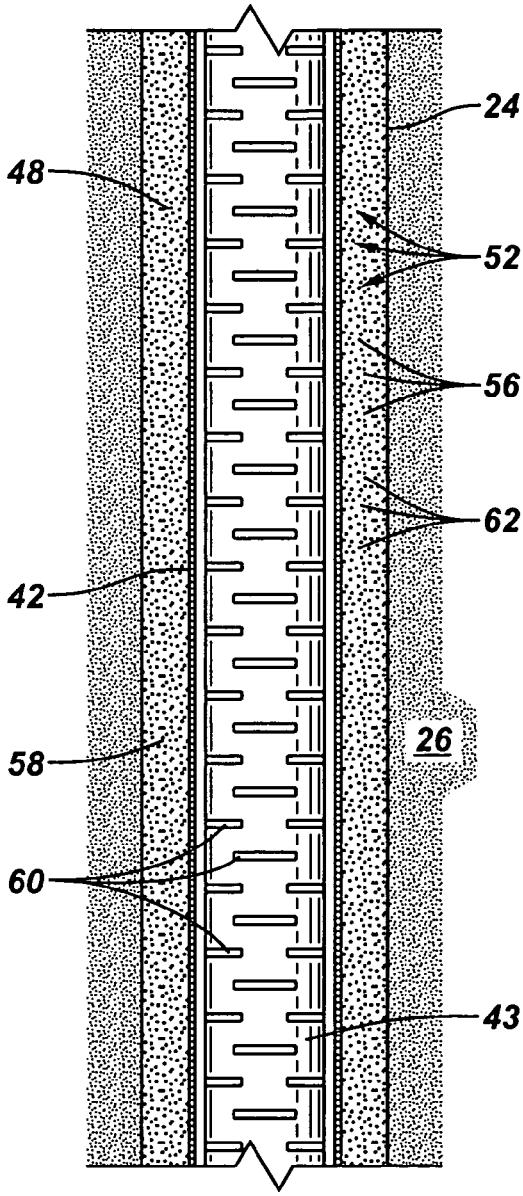
FIG. 3 is a schematic view of the wellbore in which a swell pack has been disposed about a screen, according to an embodiment of the present invention.

In the embodiment illustrated, a packer 50 is provided to generally isolate the pack region of the wellbore. To form a pack, packer 50 is set to create a seal between tubing 40 and casing 32. The aggregate filled slurry 46, as illustrated in FIG. 2, is then pumped down tubing 40 and directed through crossover 44 to enter gravel pack region 48. With additional reference to FIG. 2, slurry 46 comprises an aggregate 52 carried in a liquid 54 that generally fills the interstitial volumes between particles 56. The carrier fluid, e.g. carrier liquid 54, does not cause swelling of aggregate 52 and may be formed of a hydrocarbon based liquid or other type of fluid that does not cause premature expansion of the swellable particles. The particles 56 of aggregate 52 cooperate to create a pack 58 disposed about screen 42, as best illustrated in FIG. 3.

Once the slurry 46 is deposited, slurry dehydration occurs as the carrier fluid 54 leaves the slurry. The carrier fluid 54 can enter sand screen 42 through slots 60, for example, or the fluid can enter formation 26 by flowing radially outward into the formation. If wellbore 24 is lined with casing 32 throughout gravel pack region 48, the carrier fluid 54 can flow outwardly through perforations 34. The dehydration of slurry of 46 causes aggregate 52 to pack together tightly creating a well formed pack 58.

Figure 4:
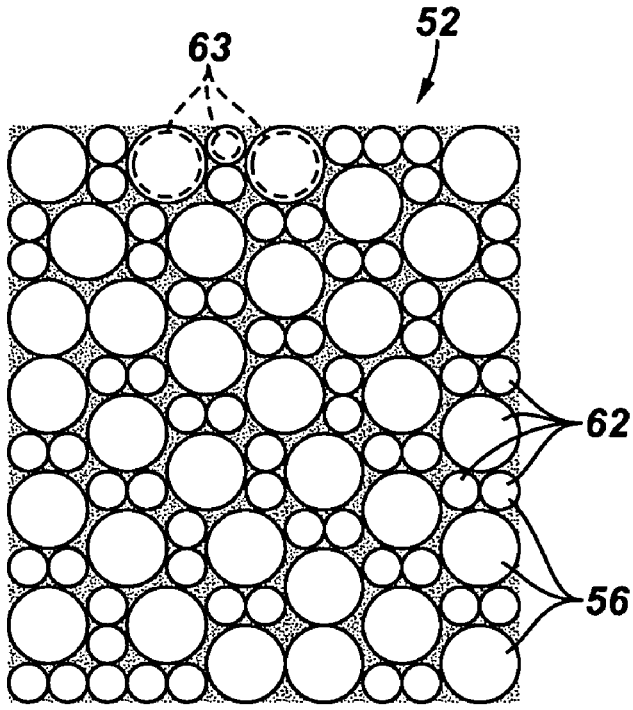
FIG. 4 is an enlarged illustration of an aggregate formed of a mixture of swellable particles used to create the swell pack illustrated in FIG. 3.

Pack 58 may be more tightly formed by using an aggregate with particles 56 having a plurality of sizes, as illustrated in FIG. 4. The range of particle sizes enables creation of pack 58 with specific properties, such as a suitable packing density having a desirable range of porosity and permeability. Additionally, particles 56 may have a variety of shapes, e.g. spherical and other various shapes, to further facilitate formation of pack 58 with specific, desired properties, as illustrated in FIG. 4.

Figure 5:
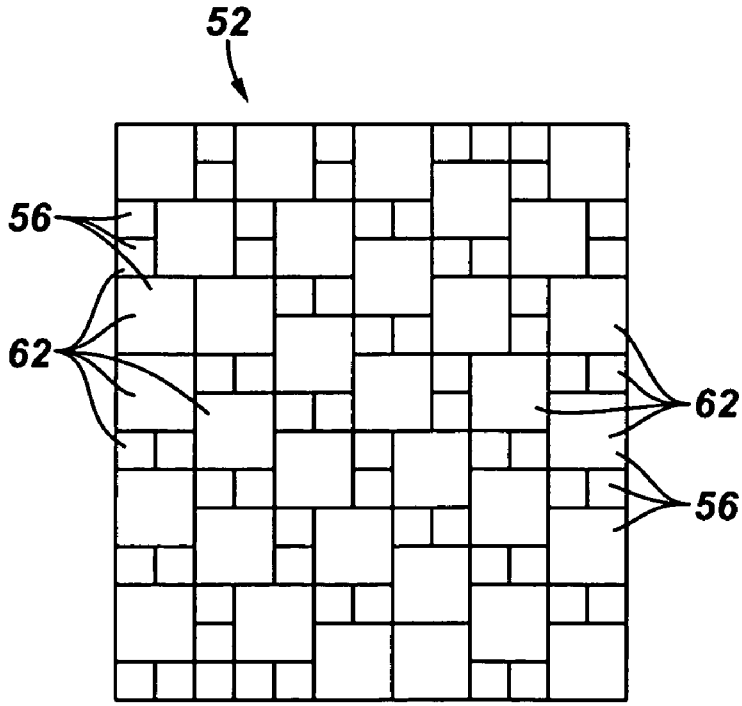
FIG. 5 is a view similar to that of FIG. 4, but showing the aggregate particles in an expanded state due to exposure to water, according to an embodiment of the present invention.

In the embodiment illustrated in FIG. 4, at least a portion of particles 56 are swellable particles 62 that swell or expand when exposed to a specific substance or substances. For example, swellable particles 62 may be formed from a material that swells in the presence of water. Alternatively, the swellable particles may be formed from a material that expands in the presence of a specific chemical or chemicals. This latter embodiment enables the specific actuation of the swellable particles by, for example, pumping the chemical(s) downhole to cause swelling of particles 62 and pack 58 at a specific time. Additionally, aggregate 52 can be a mixture of swellable particles and conventional particles, e.g. rock-based particles. In this embodiment, the swellable particles expand and swell against each other and against adjacent rock particles to reduce or eliminate the interstitial volumes between particles. In another embodiment, the particles forming aggregate 52 are substantially all swellable particles 62 that expand when exposed to water. In this latter embodiment, all particles exposed to water swell to reduce or eliminate the interstitial volumes between particles. In the embodiment of FIG. 5, for example, the particles 56 are substantially all swellable particles 62 that have been exposed to water, or another swell inducing substance, which has caused the particles to expand into the interstitial volumes. Accordingly, the swellable pack 58 has one permeability when flowing hydrocarbon fluids and another permeability after activation in the presence of specific substances that cause particles 62 to transition from a contracted state to an expanded state. Once expansion has occurred, further water flow and/or gas flow through that area of the aggregate is prevented or substantially reduced.

In alternate embodiments, particles 62 can be formed with a barrier or coating 63, as illustrated by phantom lines in FIG. 4. The coating 63 can be used to protect swellable particles 62 from exposure to a swell inducing substance, e.g. water or other specific substances, until a desired time. Then, the coating 63 can be removed by an appropriate chemical, mechanical or thermal procedure. For example, a suitable chemical can be pumped downhole to dissolve certain coatings 63 and to expose the underlying swellable material of particles 62. In other embodiments, swellable particles 62 can be formed of a swellable elastomeric material covering a non-elastomeric based material. Depending on the material used, swellable particles 62 and thus swell pack 58 can be designed to swell only when the fluid flowing through the pack reaches a water content exceeding a certain percentage. Or, the swellable material can be selected to swell to different sizes depending on the percentage of water in fluids contacting the swellable particles.

Swellable particles 62 can be formed from various materials that sufficiently swell or expand in the presence of water or other specific substances without undergoing substantial expansion when exposed to hydrocarbon based fluids. Materials that may be used in the applications described herein include elastomers that swell in the presence of water or other specific substances. Examples of swellable materials are nitrile mixed with a salt or hydrogel, EPDM, or other swelling elastomers available to the petroleum production industry. In other embodiments, additional swellable materials such as super absorbent polyacrylamide or modified crosslinked poly (meth)acrylate can be used. Examples of coatings 63 comprise organic coatings, e.g. PEEK, nitrile or other plastics, and inorganic materials, e.g. salt (CaCl), which are readily dissolved with acids. As illustrated, the swelling elastomer is formed into an appropriate aggregate for placement at specific subterranean locations where control over fluid migration/flow is desired. In forming swellable gravel packs, the aggregate must be designed, sized and shaped for use in a slurry that is pumped to a desired pack formation region, such as region 48. Furthermore, the swellable aggregate 52 may contain multiple layers of material to control future packing densities. Coatings 63 also can be applied to control exposure of the swelling elastomer to water or other swell inducing substances, or to provide complete isolation of the swelling elastomer until the coating is removed by chemical, mechanical or thermal means at a desired time.

Figure 6:
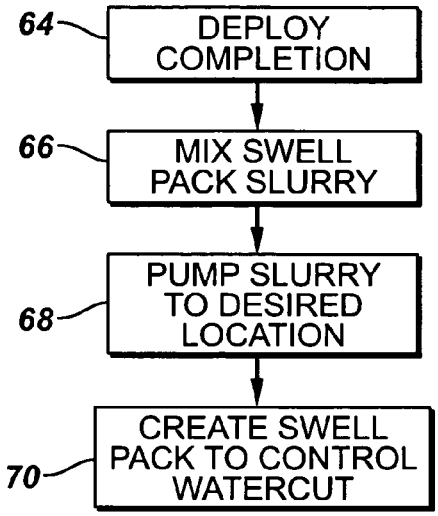
FIG. 6 is a flowchart illustrating an example of utilizing an aggregate containing swellable particles to control water flow during the production of hydrocarbon fluids, according to an embodiment of the present invention.

Aggregate 52 can be used in a variety of subterranean applications, and the present system and methodology are particularly amenable to use in hydrocarbon fluid production applications, such as gravel pack applications where there is potential for detrimental incursion of water. An example of the methodology utilized in this type of application is illustrated in flow chart format with reference to FIG. 6. Initially, a completion is deployed in a wellbore, as illustrated by block 64. The completion may be a gravel pack completion delivered downhole with a tubing string. The slurry 46 is then formed by mixing a fluid carrier and an aggregate at least partially formed by swellable particles 62, as illustrated by block 66. The slurry 46 is then pumped downhole, as done in conventional gravel packing operations, and delivered to a desired pack location, as illustrated by block 68. When the desired location is sufficiently filled with slurry 46, the slurry undergoes dehydration to create a "swell pack" as illustrated by block 70. The swell pack blocks intrusion of undesirable fluid migrating along the wellbore due to, for example, potential watercut that would otherwise result due to the production of hydrocarbon fluids from the formation.

Figure 7:
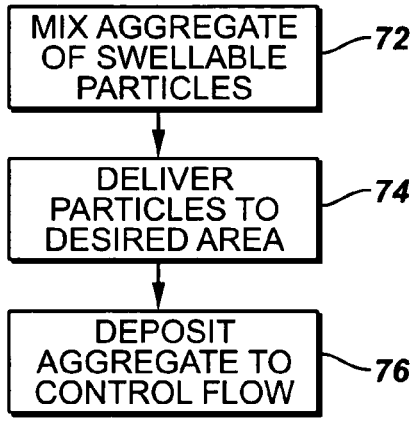
FIG. 7 is a flowchart illustrating an example of utilizing an aggregate containing swellable particles to control water flow, according to another embodiment of the present invention.

Other subterranean applications, e.g. production well related applications, also can benefit from the ability to create a pack area that swells in the presence of water to control the flow of water through that particular area. The general methodology is illustrated in FIG. 7, in which an aggregate including swellable particles is initially mixed, as illustrated by block 72. The aggregate is then delivered to a desired subterranean region susceptible to unwanted incursion of fluid, as illustrated by block 74. The aggregate can be delivered via a slurry or by other delivery methods. Regardless of the specific method, the aggregate is deposited at the desired area to control fluid flow by blocking the flow/migration of water through that particular area, as illustrated by block 76.

Figure 8:
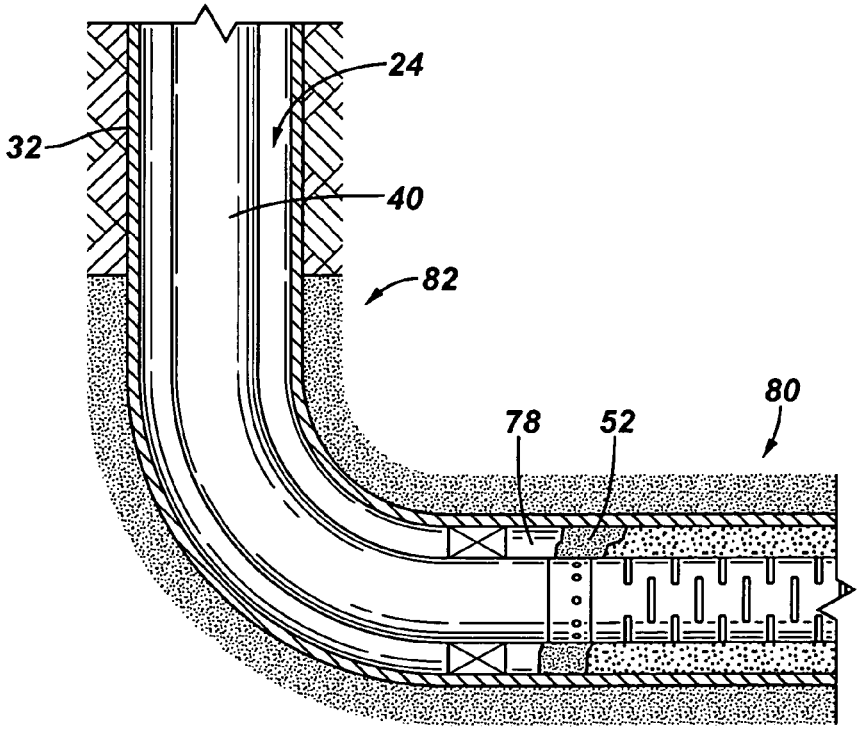
FIG. 8 is a schematic view of another subterranean application in which an aggregate containing swellable particles is deployed to control water flow, according to an embodiment of the present invention.

The general methodology outlined with reference to FIG. 7 can be used in a variety of subterranean applications. Some examples include injecting the aggregate 52 into voids 78 that sometimes occur in horizontal sections 80 of horizontal wells 82, as illustrated in FIG. 8. By filling such voids in horizontal wells, the efficiency of the overall gravel pack can be increased. The swellable particles 62 also can be dispersed in a gravel pack, as described above, to increase pack efficiency and to decrease hotspots. In other applications, the swellable particles can be distributed in a gravel pack and delivered to specific areas where water inflow has occurred to shut down further flow of water into the area. In some applications, swellable aggregate can be used along the full-length of the wellbore when there are one or more producing reservoirs or zones. The zones or areas of interest that are producing undesirable water can be selectively choked back or shut by appropriate use of the swellable aggregate. This can be accomplished without shutting in hydrocarbons from other zones of interest or producing reservoirs.

Figure 9:
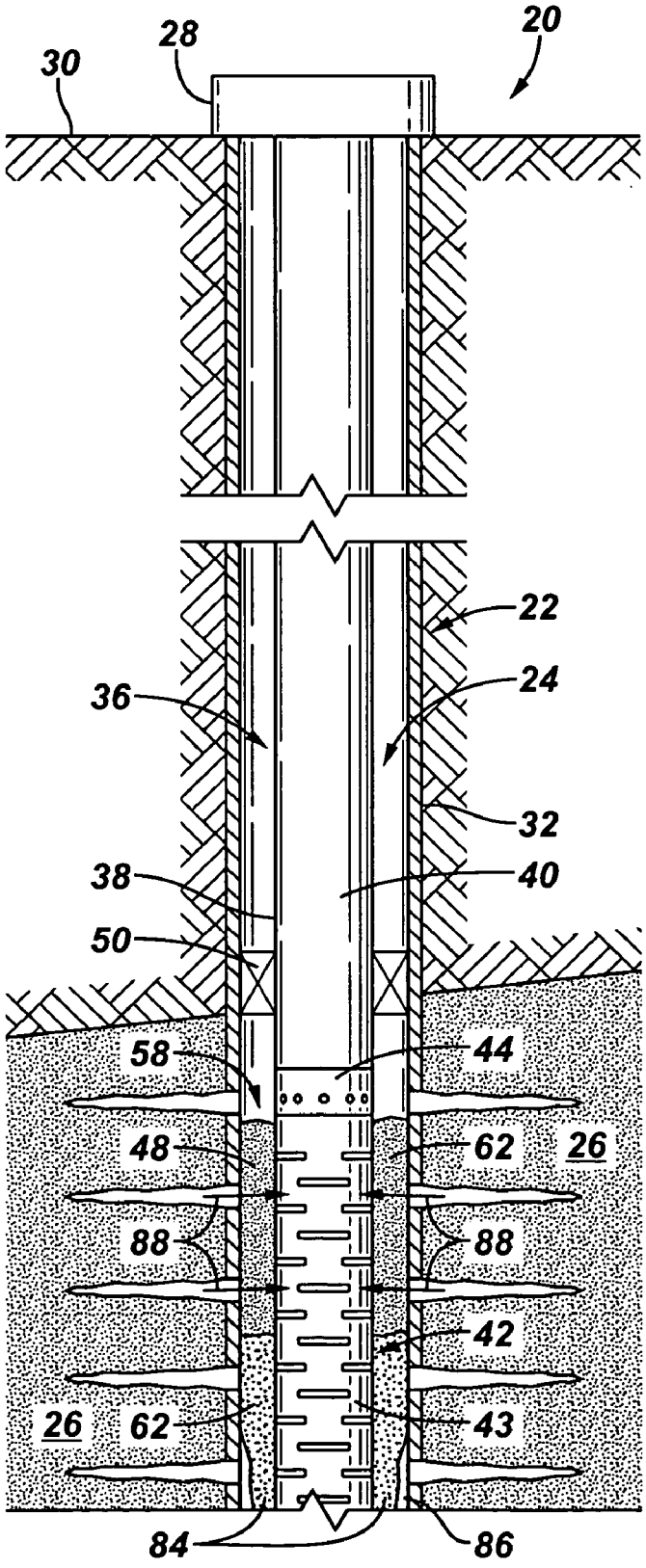
FIG. 9 is a schematic view of another subterranean application in which a pack formed of swellable particles is illustrated as partially expanded, according to an embodiment of the present invention.

Referring to another embodiment, illustrated in FIG. 9, a portion of swell pack 58 may swell as some of the swellable particles 62 are exposed water or other swell inducing substances. As illustrated, a portion 84 of swellable particles 62 and swell pack 58 has expanded due to contact with a swell inducing substance 86. By way of example, substance 86 is illustrated as water in the form of watercut progressing along the wellbore and causing pack portion 84 to swell. The expanded pack portion 84 blocks inflow of fluids at that specific region while continuing to permit inflow of fluid, e.g. hydrocarbons, from formation 26 at other regions. The inflow of well fluid is indicated by arrows 88.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method of forming a pack in a wellbore used in the production of hydrocarbons, comprising:

forming a gravel pack slurry with at least a portion of the gravel pack slurry comprising elastomeric particles that swell in the presence of a specific substance; and delivering the gravel pack slurry to a desired pack location in a wellbore to control sanding; wherein forming comprises employing elastomeric particles with a plurality of predetermined shapes selected to create a gravel pack with specific, desired properties resulting from the predetermined shapes.

2. The method as recited in claim 1, wherein the gravel pack slurry consists essentially of the elastomeric particles.

3. The method as recited in claim 1, wherein forming comprises using elastomeric particles having a plurality of sizes.

4. The method as recited in claim 1, wherein forming comprises using elastomeric particles that swell in the presence of water.

5. The method as recited in claim 1, wherein forming comprises using elastomeric particles that swell upon exposure to a fluid with a water content above a given percentage.

6. The method as recited in claim 1, wherein forming comprises using elastomeric particles that swell in proportion to the water content of a contacting fluid.

7. The method as recited in claim 1, wherein delivering comprises pumping the gravel slurry to the desired pack location.

8. The method as recited in claim 1, wherein delivering comprises creating a pack between a slotted liner and a wellbore wall.

9. A method of forming a pack in a wellbore used in the production of hydrocarbons, comprising:

forming a gravel pack slurry with at least a portion of the gravel pack slurry comprising elastomeric particles that swell in the presence of preselected chemical agents other than water; and delivering the gravel pack slurry to a desired pack location in a wellbore to control sanding.

10. A fluid control system, comprising:

a pack material having swellable particles that transition from a contracted state to an expanded state in the presence of a specific substance, wherein the swellable particles remain in the contracted state during flow of hydrocarbon fluids through the pack material;

wherein the swellable material is comprised of at least one polymer chosen from the group consisting of nitriles mixed with a salt, nitriles mixed with a hydrogel, and EPDMs.

11. The fluid flow control system as recited in claim 10, wherein the specific substance is water.

12. The fluid flow control system as recited in claim 10, wherein the specific substance comprises a preselected chemical agent.

13. The fluid flow control system as recited in claim 10, wherein the swellable particles have a plurality of sizes.

14. The fluid flow control system as recited in claim 13, wherein the swellable particles have a plurality of shapes.

15. The fluid flow control system as recited in claim 10, wherein the swellable particles swell upon exposure to a fluid with a water content above a given percentage.

16. The fluid flow control system as recited in claim 10, wherein the swellable particles swell in proportion to the water content of a contacting fluid.

17. The fluid flow control system as recited in claim 10, wherein the pack material is mixed in a slurry.

18. The fluid flow control system as recited in claim 10, wherein the pack material is located in a wellbore.

19. A method of stopping watercut along a selected line of a wellbore during production of a hydrocarbon fluid, comprising:

forming a pack material with a mixture of swellable particles having a plurality of shapes and sized, wherein the swellable material is comprised of at least one polymer chosen from the group consisting of nitriles mixed with a hydrogel and EPDMs;

determining a wellbore location susceptible to undesirable watercut; and positioning the pack material at the wellbore location.

20. The method as recited in claim 19, wherein forming comprises creating a slurry with the swellable particles.

21. The method as recited in claim 20, wherein positioning comprises pumping the slurry to the wellbore location.

22. The method as recited in claim 21, wherein positioning comprises forming a pack around a well completion.

* * * * *